US005983801A

United States Patent [19]

Brunn

[11] Patent Number: 5,983,801

[45] Date of Patent: Nov. 16, 1999

[54] SEPARATING SMOKE GRENADE

[76] Inventor: Michael Brunn, 226 Newton Rd., Plainview, N.Y. 11803

[21] Appl. No.: 09/069,340

[22] Filed: Apr. 29, 1998

[51] Int. Cl.[6] ..... F42B 12/48

[52] U.S. Cl. ..... 102/334; 102/336

[58] Field of Search ..... 102/334, 336

[56] References Cited

U.S. PATENT DOCUMENTS 3,575,111 4/1971 Richardson ..... 102/334
3,883,942 5/1975 Fichter, Jr. et al. ..... 102/334
4,624,186 11/1986 Widera et al. ..... 102/334 X
5,402,729 4/1995 Richert ..... 102/334 X
5,874,690 2/1999 Brunn ..... 102/334

*Primary Examiner*—Peter A. Nelson
*Attorney, Agent, or Firm*—Myron Amer P.C.

[57] ABSTRACT

A three-in-one smoke grenade to disperse unruly crowds that emits three smoke trails and deploys at three separate locations on the assembly site of the unruly crowd, to thereby obviate the typical defense of a crowd member throwing the smoke source to another location away from the assembly site.

1 Claim, 2 Drawing Sheets

SEPARATING SMOKE GRENADE

The present invention relates generally to improvements for a separating smoke grenade, and more particularly to improvements which contribute to the effective use of the grenade for crowd dispersal, or other such police or military end uses.

EXAMPLE OF THE PRIOR ART

It is already well known, as exemplified by U.S. Pat. No. 3,311,054 for "Smoke Marker Arrangement" issued to J. E. Foster et al. on Mar. 28, 1967, that it is advantageous to use three grenades-in-one, namely three grenades 7, 8 and 9, abutted end-to-end and each with its own starter mix 17.

However, the '054 grenades are not deployed separately, but merely burn in succession through the vacancy of the last burned grenade, as described at column 2, lines 29–46.

While the extended or prolonged duration of smoke-generation contributes to achieving the end purposes intended, it is not entirely satisfactory since a known defense is, when used for crowd dispersion, for an individual in the crowd to manually grasp the grenade and throw it away from the assembly site so that the crowd-dispersing objective of the emitted smoke from the grenade is thwarted.

Generally, it is an object of the present invention to provide a separating smoke grenade overcoming the foregoing and other shortcomings of the prior art.

More particularly, it is an object to provide an improved construction for a separating smoke grenade which provides an operating mode for plural grenade sections, such as three in number, wherein each grenade section is operational to provide a smoke-generating function and the combined grenade sections are deployed at a site of use at several locations, i.e. at a total of three in number, to thereby obviate the referred defense reaction to the grenade, as well as providing other benefits and advantages which will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

Figure 4:
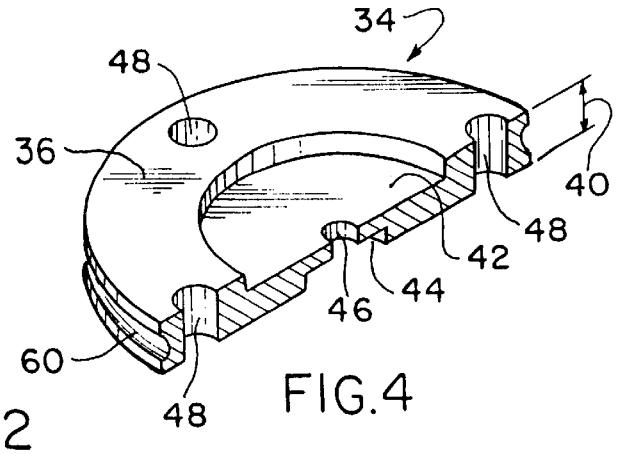
FIG. 4 is an isolated partial perspective view in one-half cross section of a grenade component.
Figure 1:
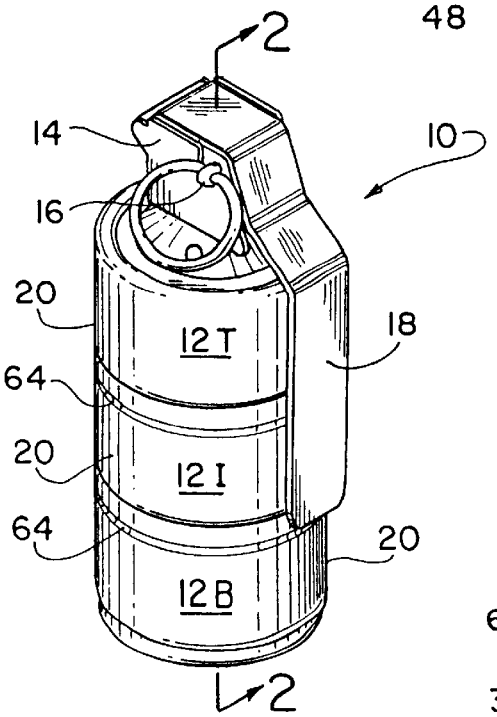
FIG. 1 is a perspective view of the within inventive separating smoke grenade.

Smoke grenades, i.e., grenades that emit smoke, are already well known, as exemplified by U.S. Pat. No. 4,353,301 issued to Kjell O. Jacobsen for "smoke Grenade" on Oct. 12, 1982, and by U.S. Pat. No. 3,311,054 issued to J. E. Foster et al for "Smoke Marker Arrangement" on Mar. 28, 1967. A primary use of the '301 smoke grenade is by law enforcement agencies to disperse from a site of assembly an unruly or otherwise unauthorized crowd. When used on such an occasion, a defense is for an individual in the crowd to manually grasp the grenade and throw it away from the assembly site so that the crowd-dispersing objective of the emitted smoke from the grenade is thwarted.

Addressing the noted defense, several known smoke grenades are typically made in separating sections, each separated section in effect being a separate functioning smoke-emitting grenade, so that deployment at a site of use occurs at several locations at the site to significantly obviate neutralizing the intended end use of the grenade. It is also desirable to achieve rapid generation of smoke from the smoke-generating separated grenade sections, again to the end of contributing to the achievement of effective crowd dispersion.

In accordance with the present invention, there is provided a separating smoke grenade, generally designated 10, of a type having, in assembled condition as best noted in FIG. 2, a superposed arrangement of smoke-emitting grenade sections, consisting of a top section 12T, and intermediate section 12I, and a bottom section 12B, the specific construction and operating mode of such sections 12A, B and C, to be subsequently described in detail.

Separating smoke grenade 10 also includes a fuse assembly 14, an arming pin 16 and a fuse handle 18, the construction and operating modes of which are each well known in grenade technology and accordingly, for brevity's sake and also so as not to obscure the within patentable advance, will not be repeated in this application.

Figure 3:
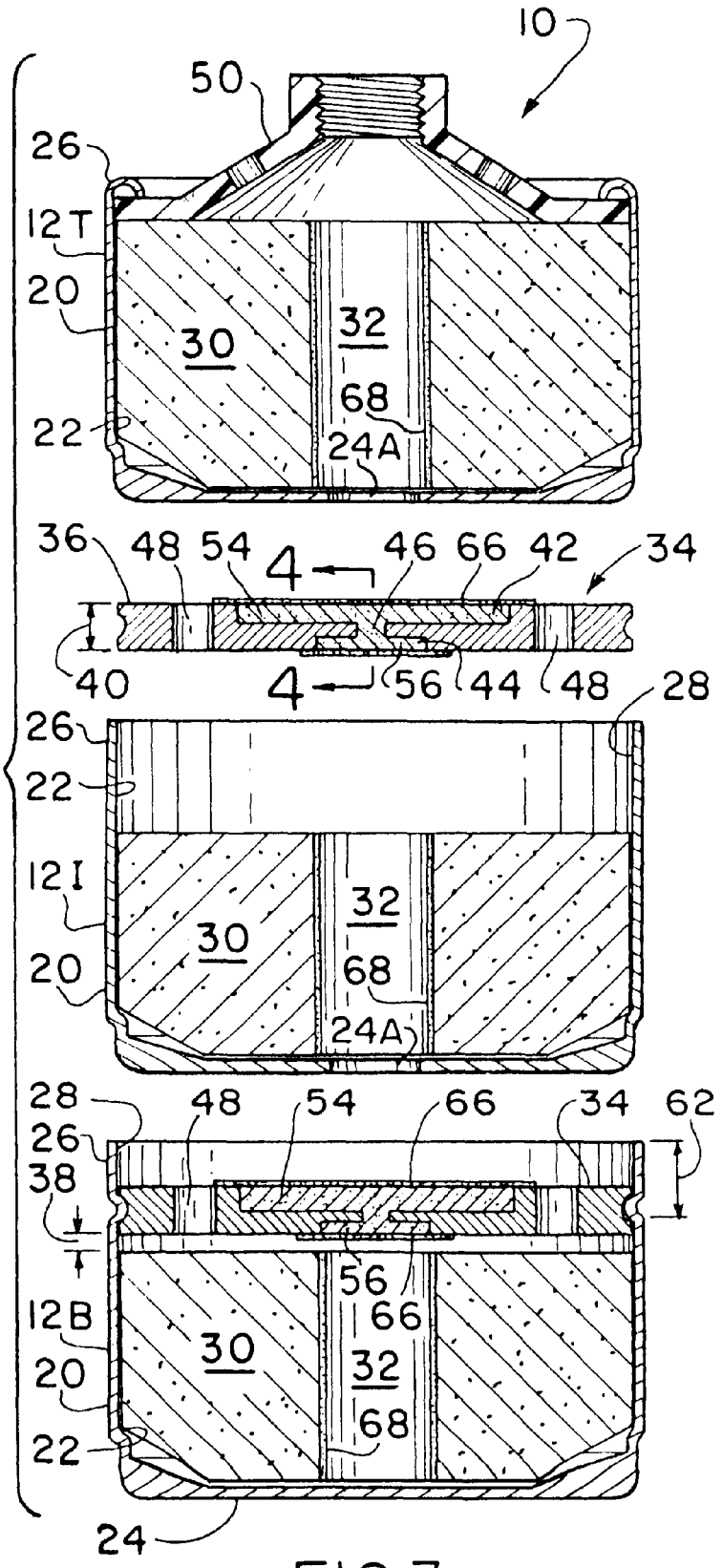
FIG. 3 is an exploded version of the individual smoke-emitting grenade sections of the grenade of FIG. 1 as also shown in cross section in FIG. 2.

More particularly, the patentable advance, as best understood from FIGS. 3 and 4, contemplates a construction almost identical for grenade sections 12I and 12B and with a slight modification in grenade section 12T, which provides the separating function in a significantly facilitated manner as well as providing other noteworthy benefits, all as will be better understood as the description proceeds. The description which follows is of the bottom grenade section 12B, and it is to be understood that similar structural features in the intermediate and top grenade sections 12I, 12T are designated by the same reference numerals.

Bottom grenade section 12B has a cylindrical wall 20 bounding a compartment 22 which is closed at a bottom end by end wall 24 and, at its upper end, has an upper edge 26 which bounds an upper opening 28. A cylindrically shaped composition pellet 30 with a central opening or core 32 is appropriately seated in compartment 22 and, as is well known, is operatively effective when the composition material of the pellet 30 is ignited to initiate a chemical reaction resulting in the generating of smoke which exits from the compartment 22 through the central opening 32.

Figure 2:
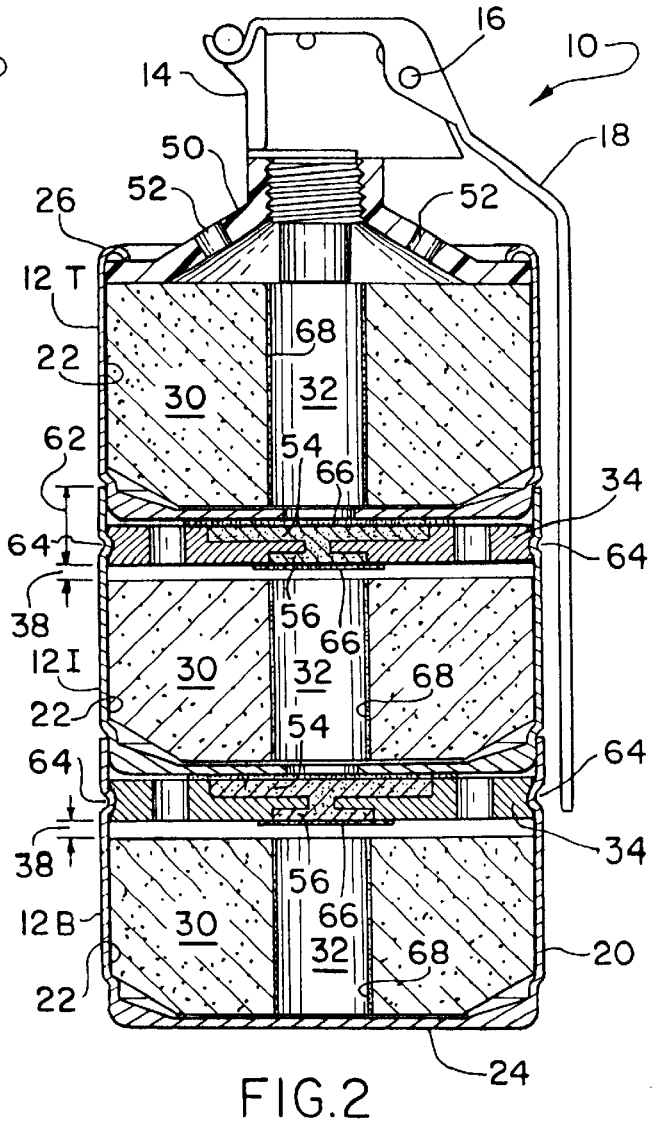
FIG. 2 is a sectional view taken along line 2—2 of FIG. 1.

A closure member generally designed 34 for the grenade bottom section upper opening 28 is shown in isolated perspective in FIG. 4 and consists of a round disc 36 of a diameter selected to be seated with only nominal clearance within upper opening 28 and with a nominal clearance 38 above the top of pellet 30 and, in a preferred embodiment having a selected thickness 40 adequate to have machined therein an upper counterbore 42 and lower counterbore 44 connected by a communication opening 46 therebetween, in which in an assembled FIG. 2 condition of the smoke grenade 10 places in vertical alignment the counterbore/openings 42, 44 of the two closure members 34 for the bottom and intermediate grenade sections 12B, 12I, respectively. Completing the closure members 34 are exit ports 48 for the generated smoke, the functional equivalent of which are in a conical cap 50 in grenade section 12T, as at 52.

In practice, a thickness W of one-quarter inches achieves the operating mode of sections-separation and rapid smoke emission from the sections in providing for the machining of the upper counterbore 42 as a repository of a separating charge 54, a lower counterbore 44 as a repository of an ignition charge 56, and of a side edge 58 which is of adequate dimension to be imparted with an annular groove

60 into which the cylindrical upper wall portion 62 is crimped, as at 64, to project into the annular groove 60 to hold in place the closure member 34 within the section opening 28 preparatory to the combustion of the separating and ignition charges 54, 56 which, in turn, are ignited by the well known cooperating operation of the fuse handle 18, arming pin 16 and fuse assembly 14.

The charges 54, 56 deposited in their respective counterbores 42, 44 are held in place by a flammable plastic film 66 adhesively secured in place across the top of counterbore 42 and below counterbore 44.

Optionally, the wall of each pellet central opening 32 is provided with a starting coating 68 of pyrotechnic material to assist in igniting the pyrotechnic or composition pellet 30. In a typical end use, during an airborne delivery of the smoke grenade 10 the charges 54 will separate the grenade sections 12T, 12I, and 12B from each other, and each the ignition charge of the closure members of grenade sections 12I, 12B will initiate the combustion of the smoke-generating pellets 30 to contribute to achieving three movement paths of the grenade sections 12T, 12I, and 12B, along each of which there occurs a volume of generated smoke effective for dispersing a crowd, marking a site, or providing other police or military purposes.

While the apparatus for practicing the within inventive method, as well as said method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

I claim:

1. Improvements in a separating smoke grenade of a type having a select number of plural grenade sections urged along separating movement paths from each other in response to an ignited separating charge means and having in each separating grenade section a smoke-generating pellet means to contribute to smoke generation along said movement paths of said grenade sections, said improvements in at least one grenade section comprising a housing formed of a closed-end cylindrical wall bounding a compartment and having edges opposite said closed-end bounding an opening into said compartment, a smoke-generating means in the form of a cylindrically shaped pellet with a hollow central core disposed in said compartment, a closure member for said compartment having a selected thickness disposed in said compartment opening in covering relation over a previously disposed said cylindrical pellet therein, a first and a second counterbore with an opening connected therebetween arranged in said closure member in an aligned relation with each other as permitted by said selected thickness of said closure member, a charge to separate a grenade section and a charge to ignite said smoke-generating pellet thereof disposed respectively in said first and second counterbores, flammable sealing means disposed in covering relation over said counterbores and said charges therein, an annular groove in said closure member as permitted by said selected thickness thereof, and a crimp in said housing cylindrical wall at a location adjacent s aid compartment opening effective to be projected into said closure member annular groove to hold said closure member in place in an adjacent clearance position above said cylindrical pellet and said charges in said counterbores in alignment with said pellet hollow central core, whereby said grenade section and a select number of similarly constructed grenade sections are adapted to be assembled end-to-end into said separating smoke grenade so as to provide a smoke-generating mode along plural separating movement paths.

* * * * *